US007036799B2

(12) United States Patent
Shepherd

(10) Patent No.: US 7,036,799 B2
(45) Date of Patent: May 2, 2006

(54) RAILING ASSEMBLY

(76) Inventor: John D. Shepherd, 13822 Bruns Rd., Manhattan, IL (US) 60442

( * ) Notice: Subject to any disclaimer, the term of this patent is extended or adjusted under 35 U.S.C. 154(b) by 0 days.

(21) Appl. No.: 10/224,728

(22) Filed: Aug. 21, 2002

(65) Prior Publication Data

US 2002/0195595 A1 Dec. 26, 2002

Related U.S. Application Data

(60) Division of application No. 09/804,549, filed on Mar. 12, 2001, now Pat. No. 6,517,056, which is a continuation-in-part of application No. 09/538,826, filed on Mar. 30, 2000, now Pat. No. 6,419,209.

(51) Int. Cl.
*E04H 17/16* (2006.01)

(52) U.S. Cl. ..... 256/73; 256/24; 256/65.01; 52/204.591; 52/204.597; 52/738.1; 403/409.1

(58) Field of Classification Search ..... 256/1, 256/25, 24, 73; 49/501, 388; 52/766, 800.16, 52/800.18, 210, 213, 217, 204.5; 403/409.1
See application file for complete search history.

(56) References Cited

U.S. PATENT DOCUMENTS 1,553,785 A * 9/1925 Ley ..... 52/297
2,039,879 A 5/1936 Brown et al.
2,169,713 A 8/1939 Stroud
2,589,517 A 3/1952 Stelzer
3,190,408 A 6/1965 Petterson
3,190,409 A 6/1965 Petterson
3,344,573 A 10/1967 Martin et al.

(Continued)

FOREIGN PATENT DOCUMENTS

DE 1237287 A * 3/1967

(Continued)

OTHER PUBLICATIONS

Blumcraft of Pittsburgh M-98 Railing Catalogue, 1997, pp. 7 & 9-13.

*Primary Examiner*—Daniel P. Stodola
*Assistant Examiner*—Ernesto Garcia
(74) *Attorney, Agent, or Firm*—Greer, Burns & Crain, Ltd.; Philip M. Kolehmainen

(57) ABSTRACT

A structural glass panel railing includes glass panels supported on a floor by a base assembly including a railing support assembly. The railing support assembly includes a shoe fastened to the floor, a base member locked to the shoe by a cam lock lever and a channel member having a pocket receiving the panel. The base member may be attached directly to the floor. The channel member is received in a groove of the base member and is held by a wedge system. The wedge system can be formed by mating tapers on the channel member and the groove or by a wedge member inserted into the groove. A handrail assembly includes a handrail channel member receiving the top edge of the panel. The handrail channel member is received in a groove in a handrail.

3 Claims, 3 Drawing Sheets

U.S. PATENT DOCUMENTS

| | | | | |
|---|---|---|---|---|
| RE28,643 | E | | 12/1975 | Blum |
| 4,067,548 | A | | 1/1978 | Murphy |
| 4,103,874 | A | | 8/1978 | Horgan, Jr. |
| 4,220,420 | A | * | 9/1980 | Aston et al. ..... 49/436 |
| 4,325,488 | A | | 4/1982 | Ketner |
| 4,364,209 | A | | 12/1982 | Gebhard |
| 4,423,582 | A | | 1/1984 | Yates |
| 4,569,383 | A | | 2/1986 | Wentzel |
| 4,920,717 | A | | 5/1990 | Hooper, Jr. |
| 5,205,099 | A | * | 4/1993 | Grunhage et al. ..... 52/204.5 |
| 5,339,583 | A | * | 8/1994 | Hrdlicka et al. ..... 52/204.53 |

FOREIGN PATENT DOCUMENTS

| | | | |
|---|---|---|---|
| GB | 2254360 | | 10/1992 |
| JP | 2000336936 | A * | 12/2000 |

* cited by examiner

RAILING ASSEMBLY

CROSS REFERENCE TO RELATED APPLICATION

This is a division of U.S. application Ser. No. 09/804,549 filed on Mar. 12, 2001, now U.S. Pat. No. 6,517,056 which was a continuation-in-part of U.S. application Ser. No. 09/538,826 filed on Mar. 30, 2000, now U.S. Pat. No. 6,419,209.

FIELD OF THE INVENTION

The present invention relates to railings, and more particularly to an improved railing assembly in which a panel such as a glass panel is mounted vertically above a floor support surface by a base assembly.

DESCRIPTION OF THE PRIOR ART

A structural glass rail system includes vertical glass panels with bottom edges that are secured to a floor surface by a base support assembly. The top edges of the glass panels may support a top rail or handrail. Transparent or translucent glass panels provide an attractive appearance that is desirable to architects and designers as well as owners and users of commercial spaces and homes. However the appeal of structural glass rail systems has been limited by the difficulty and cost of installing known systems and the costs and inconvenience of repairing a damaged or marred glass panel after the initial installation. There is a long-standing but unfilled need for a structural glass panel rail system that is easy to install, relatively inexpensive, attractive and easy to repair.

In a typical known structural glass panel system cement is used to hold the glass panels in place. A receiving shoe is secured to a floor directly or by means of a support angle bracket. The shoe includes a pocket for receiving the bottom edge of a glass panel. After the shoe is in place, a glass panel is placed into the pocket, often on top of rubber spacers that hold the panel above fasteners or sharp edges that could cause breakage. Other spacers and/or wooden wedges are used at the sides to center the panel in the groove and to hold it temporarily in a vertical position. A quick setting cement is poured into the groove in the shoe in a two step process. After cement partly fills the groove and sets, the temporary wedges or spacers are removed, and the filling of the groove is completed in a second step. A cover or caulking is used to cover the cement and provide an acceptable appearance. The installation requires much skilled labor and time. Leakage and spillage of wet cement is a problem because it is difficult to completely seal the groove. Stairs and inclines add to these problems. In order to replace a panel, it must be broken out and the remaining edge and cement must be extracted with tools.

SUMMARY OF THE INVENTION

A principal object of the present invention is to provide an improved railing system of the type including structural flat panels such as glass panels. Other objects are to provide a railing system that can be installed quickly and without special tools; to provide a railing system that can be assembled on site without the necessity for factory pre-assembly operations; to provide a railing assembly that does not require concrete and does not require fasteners for holding parts of the assembly together; to provide a railing assembly that can be installed using an existing type of base member; to provide a railing assembly that is attractive in appearance and that is not expensive to make or install; to provide a railing base assembly that can be disassembled for replacement of a panel; and to provide a railing assembly that overcomes disadvantages of known railing systems.

In brief, in accordance with the invention there is provided a railing system for permanently mounting a railing panel having a peripheral edge and opposed planar side faces. An elongated base includes an elongated support groove defined in the base. An elongated channel member receiving the edge of the panel. The channel member has a generally U-shaped cross section including a base portion and opposed side walls overlying the opposed faces of the panel. The channel member and the edge of the panel are received in the elongated groove. A wedge system in the elongated support groove locks channel member and the edge of the panel into the elongated groove.

BRIEF DESCRIPTION DRAWING

The present invention together with the above and other objects advantages may best be understood from the following detailed description of the preferred embodiment of the invention illustrated in the drawings, wherein.

DESCRIPTION OF THE PREFERRED EMBODIMENTS

Figure 1:
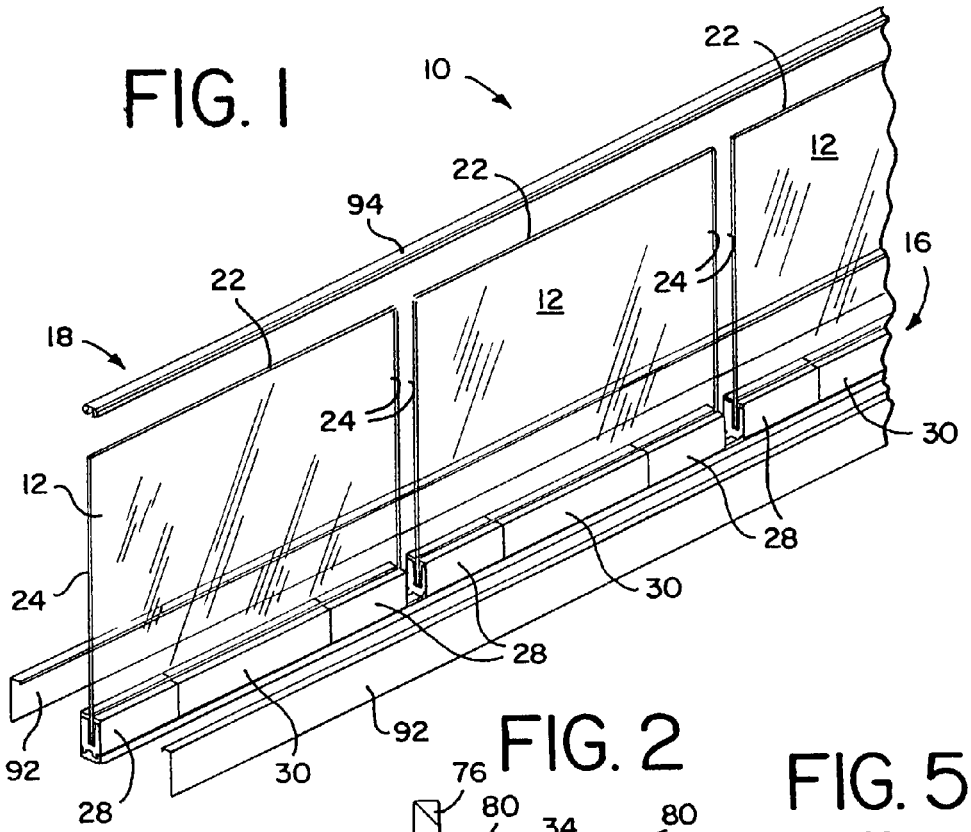
FIG. 1 is an isometric view, partly exploded, of a railing assembly constructed in accordance with the present invention.

Having reference now to the drawings, FIG. 1 is an illustration of a railing assembly designated as a whole by the reference character 10 and constructed n accordance with the present invention. In general, the railing assembly 10 includes a series of structural glass panels 12 permanently supported in a vertical orientation above a horizontal floor 14 (FIGS. 6 and 7) by a base mounting assembly 16.

A handrail assembly 18 is supported by the panels 12. The present invention is especially suited to railing assemblies having glass panels 12. However the principles of the invention are applicable to other similar flat panels such as metal or plastic or lattice panels and the like. Although the invention is described in connection with the horizontal floor 14, a railing assembly of the present invention can be installed over an inclined surface, for example at or near a ramp or stairway.

The glass panels 12 have a peripheral edge including a bottom edge 20, a top edge 22 and side edges 24. The panels 12 also have opposed, parallel, flat surfaces or faces 26. The panels 12 can be uniform in length and height, or if desired can have various sizes to accommodate installation requirements and design themes. One advantage of the present invention is that it permits great flexibility in design and placement of the railing assembly.

The base assembly 16 in the illustrated railing assembly 10 includes a plurality of railing support assemblies 28. Two assemblies 28 are used to support each panel 12, and these are located at opposite ends of the bottom edge 20 of each panel 12. Between each pair of assemblies 28 there is provided a spacer 30 so that the base assembly 16 has a uniform sectional shape. Alternatively there may be a single base assembly for one or more panels 12, and the spacers 30 may be omitted.

Figure 2:
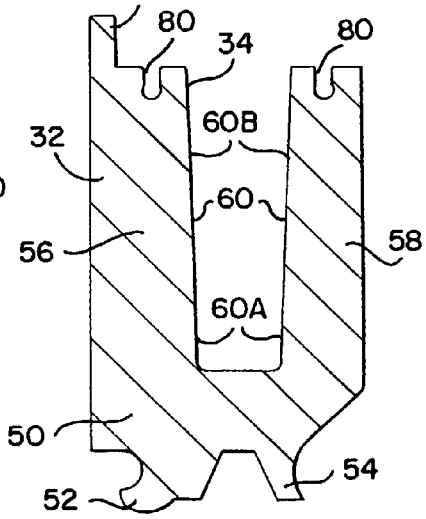
FIG. 2 is a vertical sectional view, on an enlarged scale, of the base member of the railing assembly of FIG. 1.
Figure 5:
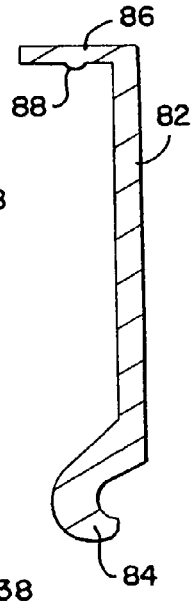
FIG. 5 is a vertical sectional view of the cam lock of the railing assembly.
Figure 4:
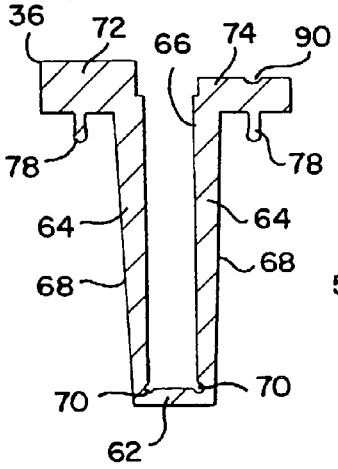
FIG. 4 is a vertical sectional view of the channel member of the railing assembly.

Each railing support assembly 28 includes an elongated base member 32 (FIG. 2) having a support groove 34 formed throughout its length, together with an elongated channel member 36 (FIG. 4) that receives the bottom edge 20 of the panel 12. In accordance with the invention, the channel member 36 is inserted into the groove 34 to act as a wedge and secure, position and support the panel 12 without the need for concrete or adhesives or fasteners for interconnecting the panel 12, the channel member 36 and the base member 32.

Figure 3:
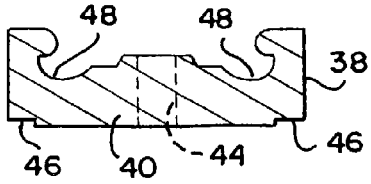
FIG. 3 is a vertical sectional view of the shoe of the railing assembly of FIG. 1.

A shoe 38 (FIG. 3) supports the base member 32 and provides for securing the base assembly 16 to the floor 14. The shoe 38 includes a bottom wall 40 that is held against the surface of floor 14 by fasteners 42 (FIGS. 6 and 7) that extend through holes 44 in the shoe 38 and may, for example, be threaded into anchors embedded in the floor 14. If desired for a more secure attachment, mounting brackets may also be used. A pair of trim receiving grooves 46 are provided at the sides of the bottom wall 40. A pair of elongated sockets 48 extend along the length of the shoe 38. The shoe 38 has a uniform cross section throughout its length, and preferably is an extruded aluminum part.

Figure 6:
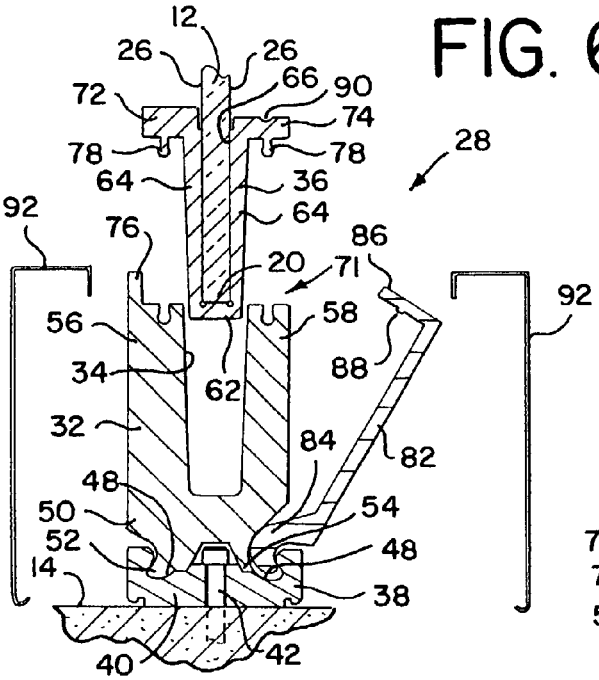
FIG. 6 is a vertical sectional view of the of the base assembly of the railing assembly showing the components during installation of the railing assembly.
Figure 7:
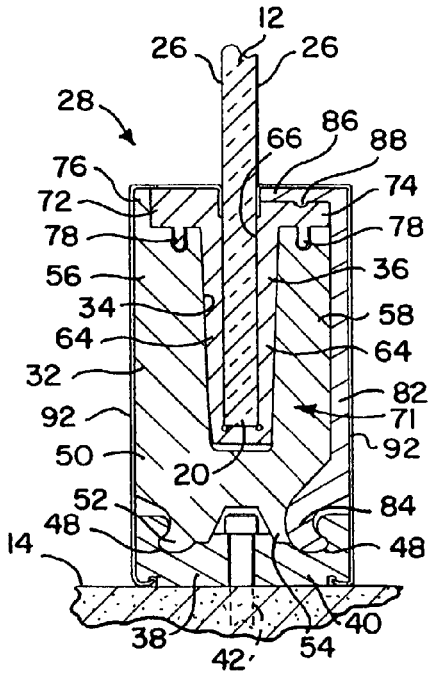
FIG. 7 is a view like FIG. 6 showing the installed base assembly of the railing assembly.

The base member 32 includes a lower body portion 50 with a downwardly extending full locking projection or foot 52 at one side and a partial locking projection or foot 54 at the other side. With the base member 32 tilted or inclined around its longitudinal axis, the full foot 52 can be inserted into one of the sockets 48, and when the base member 32 is returned to is vertical position, the partial foot 54 drops into the other socket 48 as seen in FIG. 6. A pair of side walls 56 and 58 extend upward from the lower body portion 50, one at each side of the channel 34. The side walls 56 and 58 have parallel outer surfaces and interfacing inner wall surfaces 60 that define the sides of the support groove 34. Lower portions 60A of these surfaces are parallel to one another, and in the embodiment of FIGS. 1–7, the upper portions 60B are slightly inclined so that the mouth of the support groove 34 is slightly wider than the base of the groove 34. For example, the parallel portions may be about one-fourth of the total height of the surfaces 60. The base member 32 has a uniform cross section throughout its length, and preferably is an extruded aluminum part.

Channel member 36 includes a base portion 62 flanked by a pair of leg portions 64 defining a pocket 66 having a uniform width that is substantially equal to or preferably slightly larger than the thickness of the panel 12 so that the panel 12 can be received into the pocket 66 without excessive resistance. The leg portions 64 in the embodiment of FIGS. 1–7 have outer surfaces 68 that are slightly inclined or wedge shaped, with a minimum thickness at the base portion 62. The intersections of the base portion 62 and the leg portions 64 are provided with relieved areas 70 permitting the leg portions 64 to flex relative to the base portion 62. The channel member 36 has a uniform cross section throughout its length, and preferably is an extruded aluminum part.

To assemble the base mounting assembly 16, the shoe 38 is attached by fasteners 42 to the floor 14. The base member 32 is connected to the shoe 38, with the full foot 52 and the partial foot received in the sockets 48. The channel member 36 is placed onto the panel 12, with the bottom edge 20 of the panel adjacent to the base portion 62 and with the leg portions 64 overlying the panel faces 26. A spacer film or membrane can be present between the leg portions 64 and the panel 12 if desired.

The channel member 36 with panel 12 assembled to it is then inserted into the support groove 34 in the base member 32. The narrowest part of the channel member 36 is received into the widest part of the groove 34, and initially there is clearance between the wall surfaces 60 of the groove 34 and the surfaces 68 of the channel member 36. As the channel member 36 descends and approaches its final, lowermost position, the inclined surfaces 60B come into contact with the mating, similarly inclined surfaces 68, forming a wedge system generally designated as 71. Surfaces 60B and 68 of the wedge system 71 extend for most or all of the height of the pocket 66, and are inclined at only a small angle from vertical. In the final part of the relative movement, the inter-surface wedge contact causes the leg portions 64 to flex or pivot slightly toward one another, tightly clamping and locking the panel 12 in the assembly. The installer may need to tap the panel downward to achieve full insertion.

Channel member 36 has a pair of upper flange portions 72 and 74 that lie on top of the base member 32. Flange portion 72 is thicker than flange portion 74 and is received next to an upward extension 76 of the base member 32. The inserted channel member 36 is tightly held by the wedge action of wedge 71 in the groove 34 of the base member 32. In the illustrated embodiment of the invention, this attachment is augmented by receipt of retention fingers or ribs 78 on flanges 72 and 74 into grooves 80 in the base member 32.

When the channel member 36 is seated in the base member 32, the base member is locked to the shoe 38 by a cam lock lever 82. Lever 82 has a lower cam portion 84 that is received in one of the sockets 48 next to the partial foot 54 of the base member 32. When the lever 82 is pivoted up to its final position (FIG. 7) it traps the partial foot 54 in the socket 48 and locks the base member 32 onto the shoe 38. The lever 82 includes an upper flange 86 that overlies the thinner flange portion 74. The flange 86 and the top surface of the base member 32 have mating detent protrusions 88 and recesses 90 to retain the lever 82 in position. The cam lock lever 82 has a uniform cross section and may be an extruded aluminum part. Trim pieces 92 may be attached to opposite sides of the railing support assemblies 28 to provide a desired appearance.

In the embodiment of the invention illustrated in FIGS. 1–7, each railing support assembly 28 may be, for example, twelve inches in length. In each assembly 28, the shoe 38, the base member 32, the channel member 36 and the cam lock lever 82 extend the full length of the assembly 28. However, other variations are possible. As one example, the assembly 28 can use one or more channel members 36 and/or one or more levers 82, each shorter than the length of the assembly 28.

Figure 8:
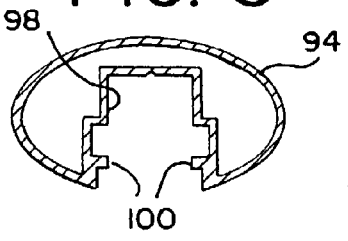
FIG. 8 is a vertical sectional view on an enlarged scale of the handrail of the railing assembly of FIG. 1.
Figure 9:
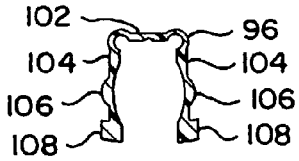
FIG. 9 is a vertical sectional view of the rail wedge member of the railing assembly.
Figure 10:
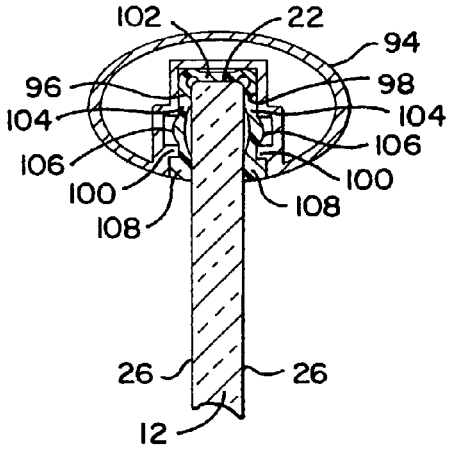
FIG. 10 is a vertical sectional view of the handrail assembly of the railing assembly.

Referring now to FIGS. 8–10, the handrail assembly 18 includes a rail 94 and a rail channel member 96. Rail 94 defines a support groove 98 having a relatively thinner base portion 98A and a relatively thicker portion 98B including a rib 100. The channel member 96 includes a base portion 102 and a pair of leg portions 104 spaced apart by a distance approximately equal to or slightly larger than the thickness of the panel 12. A wedge shape is provided by a pair of enlarged portions 106 of the leg portions 104. A pair of flange portions 108 are formed at the ends of the leg portions 104. The rail 18 is preferable an extruded aluminum part, and the channel member 96 is preferably an extrusion of a flexible plastic material such as vinyl.

To assemble the rail assembly, the rail channel member 96 is placed upon the top edge 22 of the panel 12. The leg portions overlie the panels faces 26. Then the rail 94 is forced down onto the channel member 96 assembled with the panel 12. The channel member 96 seats in the groove 98 with a wedge action. The base portion 102 is received in the thinner groove portion 98A and the enlarged portions 106 are received in the thicker portions 98B. The flange portions 108 are received against the ribs 100. A wedge action holds the rail assembly 18 securely on the panel 12.

Figure 11:
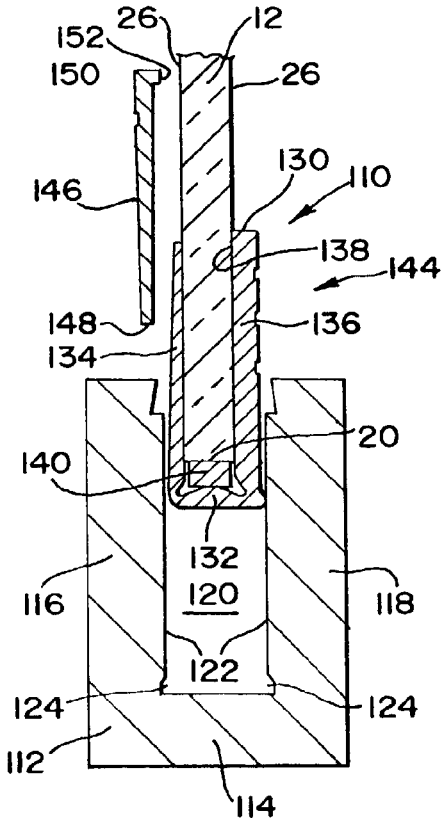
FIG. 11 is a vertical sectional view of another embodiment of a base assembly of a railing assembly showing the components during installation of the railing assembly.
Figure 12:
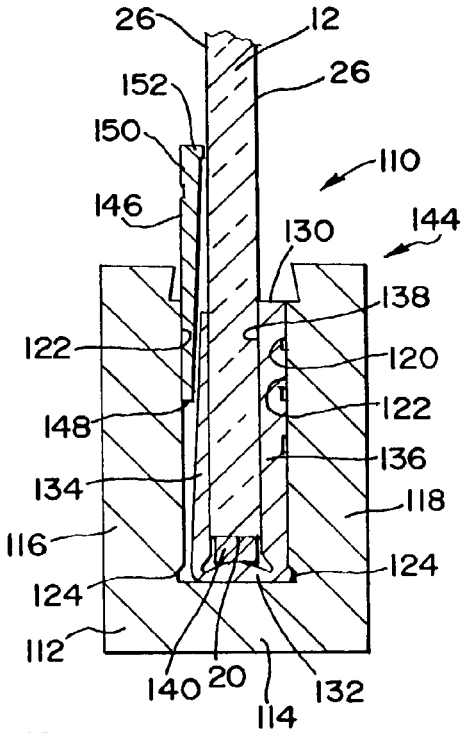
FIG. 12 is a view like FIG. 11 showing the components at a subsequent point during installation of the base assembly.
Figure 13:
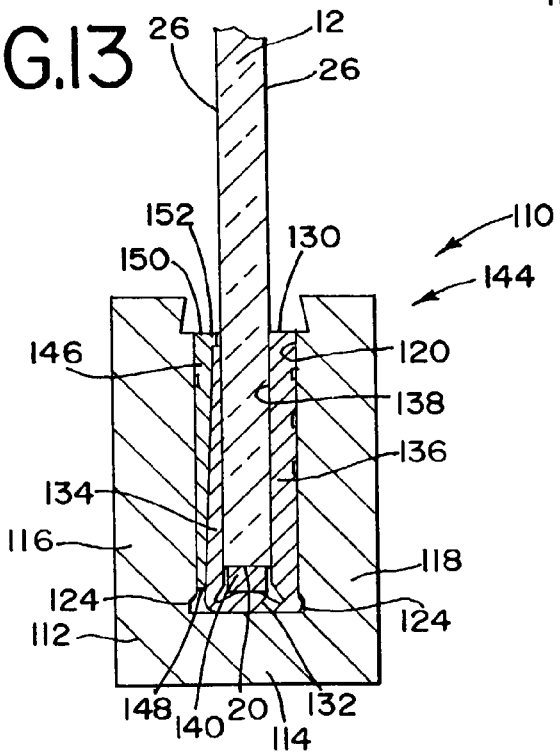
FIG. 13 is a view like FIG. 11 showing the completed installation of the base assembly.

An alternative base assembly 110 for permanently mounting the panel 12 is seen in FIGS. 11–13. A base member 112 is fixed to a floor surface like the floor 14 of FIGS. 6 and 7, with suitable fasteners and/or brackets. The base member 112 includes a base portion 114 and a pair of upstanding side wall portions 116 and 118 defining a support groove 120. Interfacing walls 122 of the groove 120 are flat and parallel to one another. This simple groove shape is typical of base members used in known railing systems, and an advantage of the base assembly 110 is that the base member 112 can be of an existing type that is intended to be used with conventional rail panel fastening systems. Relieved portions 124 may be provided at the corners of the base portion 114 and walls 122. The base member 112 has a uniform cross section throughout its length, and preferably is an extruded aluminum part.

A channel member 130 includes a base portion 132 flanked by a pair of leg portions 134 and 136 defining a pocket 138 having a uniform width that is substantially equal to or slightly larger than the thickness of the panel 12 so that the panel 12 can be received in the pocket 138. The leg portion 134 has a uniformly tapered shape, with a maximum thickness near the base portion 132 and a minimum thickness at the top entry mouth of the pocket 138. The other leg portion 136 has a uniform thickness. If desired the leg 136 could be tapered in shape like the leg 134. The intersections of the base portion 132 and the leg portions 134 and 136 may provided with relieved areas defining hinge areas and permitting the leg portions 134 and 136 to flex relative to the base portion 132. The channel member 130 has a uniform cross section throughout its length, and preferably is an extruded aluminum part.

To assemble the base mounting assembly 110, the base member 112 is attached by fasteners and/or brackets to a floor. The channel member 130 is placed onto the panel 12 (FIG. 11), with the bottom edge 20 of the panel 132 supported above the base portion 132 by spacer blocks 140. The panel 12 is received in the pocket 138 with the leg portions 134 and 136 overlying the opposed panel faces 26. A spacer film or membrane can be installed between the channel member 130 and the panel 12 if desired. The channel member 130 with panel 12 assembled to it is then inserted into the support groove 120 in the base member 112. As seen by comparing FIGS. 11 and 12, the channel member 130 is inserted until the base portion 132 bottoms against the base portion 114 of the base member 112.

A wedge system generally designated as 144 locks the channel member 130 and the panel 12 into the support groove 120 of the base member 112. A wedge member 146 has tapered side faces and is thinnest at its bottom edge 148 and thicker near its top 150. The wedge member 146 is inserted into the support groove 120 next to the channel side wall 134, and is forced down into the groove 120 until a head portion 152 bottoms on the top of the side wall 134. The wedge member 146 and the side wall 134 of the wedge system 144 are tapered throughout most or all of the height of the pocket 138, and are inclined or tapered at only a small angle from vertical. The wall 134 is shorter than the wall 136 to provide a trim and symmetrical appearance when the wedge member 146 is in place (FIG. 13). In the installed position of FIG. 13, the wedge member 146 holds, positions and locks the channel member 130 and panel 12 in place in the groove 120 of the base member 112. As seen in FIG. 13, when installed the thickness of leg portion 136 is equal to the combined thickness of leg portion 134 and the wedge member 146 and the panel 12 is centered in the support groove 120. The wedge member 146 has a uniform cross section throughout its length, and preferably is an extruded aluminum part. If wall 136 is tapered like the wall 134, a wedge member 146 can be inserted at both sides of the channel member 130 and panel 12.

The lengths of base member 112, the channel member 130 and wedge member 146 can be selected to suit any particular installation. In a typical installation, the base member 112 can be as long as a series of aligned panels, or as long as a single panel, or shorter base members 112 can be spaced end to end or spaced apart along a panel or series of panels. A plurality of individual channel members 130 can be used with each panel 12. For example, each channel member 130 may be a few inches in length, and can be spaced at intervals of a foot or two along the edge of the panel 12. Each channel member 130 can receive a wedge member 146 having a length about the same as the channel member 130.

While the present invention has been described with reference to the details of the embodiment of the invention shown in the drawing, these details are not intended to limit the scope of the invention as claimed in the appended claims.

What is claimed is:

1. A panel assembly comprising a panel having an elongated edge and first and second opposed panel faces;

an elongated, rigid, panel-receiving body having a longitudinal axis;

an elongated, axially extending, panel-receiving groove defined in said body, said groove including an open mouth and interfacing, spaced apart first and second side walls extending inwardly from said mouth;

said edge of said panel being received in said groove; and a wedge system in said groove securing said panel in said panel receiving body;

said wedge system comprising first and second tapered wedges in said groove between said first face of said panel and said first side wall of said groove;

both said first and second wedges being inclined at a small angle relative to said first and second opposed panel faces;

said first wedge having a thick portion adjacent said open mouth of said panel receiving groove and having a thin portion spaced from said open mouth of said panel receiving groove; and said second wedge having a thin portion adjacent said open mouth of said panel receiving groove and having a thick portion spaced from said open mouth of said panel receiving groove said side walls of said panel receiving groove being parallel to said first and second faces of said panel and said first and second wedges having equal tapers a spacer in said groove between said second face of said panel and said second side wall of said groove, said spacer having a uniform thickness equal to the combined thickness of said first and second wedges.

2. A panel assembly comprising;

a panel having an elongated edge and first and second opposed panel faces;

an elongated, rigid, panel-receiving body having a longitudinal axis;

an elongated, axially extending, panel-receiving groove defined in said body, said groove including an open mouth and interfacing, spaced apart first and second side walls extending inwardly from said mouth;

said edge of said panel being received in said groove; and a wedge system in said groove securing said panel in said panel receiving body;

said wedge system comprising first and second tapered wedges in said groove between said first face of said panel and said first side wall of said groove;

said first wedge having a thick portion adjacent said open mouth of said panel receiving groove and having a thin portion spaced from said open mouth of said panel receiving groove;

said second wedge having a thin portion adjacent said open mouth of said panel receiving groove and having a thick portion spaced from said open mouth of said panel receiving groove;

a spacer in said groove between said second face of said panel and said second side wall of said groove; and a generally U-shaped channel member located along said edge of said panel in said groove, said channel member having an end portion overlying said panel edge and a pair of spaced leg portions overlying said first and second panel faces, one of said leg portions comprising said spacer and the other of said leg portions comprising one of said wedges.

3. A panel assembly comprising:

a panel having an elongated edge and first and second opposed panel faces;

an elongated, rigid, panel-receiving body having a longitudinal axis;

an elongated, axially extending, panel-receiving groove defined in said body, said groove including an open mouth and interfacing, spaced apart first and second side walls extending inwardly from said mouth;

said edge of said panel being received in said groove; and a wedge system in said groove securing said panel in said panel receiving body;

said wedge system comprising first and second tapered wedges in said groove between said first face of said panel and said first side wall of said groove;

said first wedge having a thick portion adjacent said open mouth of said panel receiving groove and having a thin portion spaced from said open mouth of said panel receiving groove;

said second wedge having a thin portion adjacent said open mouth of said panel receiving groove and having a thick portion spaced from said open mouth of said panel receiving groove;

said side walls of said panel receiving groove being parallel to one another;

said side walls of said panel receiving groove being parallel to said first and second faces of said panel;

said first and second wedges having equal tapers;

a spacer in said groove between said second face of said panel and said second side wall of said groove, said spacer having a uniform thickness equal to the combined thickness of said first and second wedges; and a generally U-shaped channel member located along said edge of said panel in said groove, said channel member having an end portion overlying said panel edge and a pair of spaced leg portions overlying said first and second panel faces, one of said leg portions comprising said spacer and the other of said leg portions comprising one of said wedges.

* * * * *